United States Patent [19]

Weber

[11] 4,141,306

[45] Feb. 27, 1979

[54] THREAD TENSIONING APPARATUS FOR SEWING MACHINES

[75] Inventor: Karl Weber, Kaiserslautern, Fed. Rep. of Germany

[73] Assignee: The Singer Company, New York, N.Y.

[21] Appl. No.: 846,970

[22] Filed: Oct. 31, 1977

Related U.S. Application Data

[63] Continuation-in-part of Ser. No. 749,577, Dec. 10, 1976.

[51] Int. Cl.[2] ..... D05B 47/00

[52] U.S. Cl. ..... 112/254

[58] Field of Search ..... 112/254, 255; 242/147 R, 150 R

[56] References Cited

U.S. PATENT DOCUMENTS

| | | | |
|---|---|---|---|
| 2,609,772 | 9/1952 | Casas-Robert | 112/254 |
| 2,760,458 | 8/1956 | Ayres | 112/254 |
| 3,366,083 | 1/1968 | Ketterer et al. | 112/254 |
| 3,557,731 | 1/1971 | Casas-Robert | 112/254 |
| 3,667,414 | 6/1972 | Illes et al. | 112/254 |

*Primary Examiner*—George H. Krizmanich

*Attorney, Agent, or Firm*—Robert E. Smith; Edward L. Bell; William V. Ebs

[57] ABSTRACT

This disclosure relates to thread tensioning apparatus for sewing machines of the type disclosed in U.S. Pat. No. 3,667,414, issued June 6, 1972, and in particular has for its purpose a simplification of such a mechanism by providing a novel tension transmission means including a leaf spring for transmitting spring pressure to the thread tensioning discs of said mechanism, an adjustable abutment means positioned against one side of said spring means provides for presetting the initial minimum tension on the leaf and a slidable fulcrum member bearing against the other side of said spring member is adjustable for varying the pressure exerted on the discs. The relationship of fulcrum positions, which may be adjusted by means of a dial or the like, with respect to resulting tension applied to the thread may be caused to occur in an advantageous non-linear manner by choice if the proper contour of the leaf spring. For purposes of this invention the contour of the leaf spring in width, thickness, or free state curvature may be varied to obtain the non-linear response.

9 Claims, 7 Drawing Figures

THREAD TENSIONING APPARATUS FOR SEWING MACHINES

This is a continuation-in-part of my U.S. Pat. application Ser. No. 749,577 filed Dec. 10, 1976.

BACKGROUND OF THE INVENTION

The subject invention relates to threading apparatus for sewing machines and in particular an adjustable thread tension device which includes, in general, a plurality of thread friction washers or discs between which the thread is placed during operation of the sewing machine. The thread friction discs may be spring biased towards one another with the spring tension being adjustable so that the tension on the thread may be varied. A mechanism of this type is disclosed in U.S. Pat. No. 3,667,414, issued on June 6, 1972, and assigned to the same assignee as the subject application. Tension devices of the type referred to herein include a tension transmission mechanism through which an operator by adjusting a dial or the like may vary the tension on the thread. The operator adjustment is transmitted through a lever mechanism and to an axially slidable member which is operably connected to the thread tension discs through a spring means for varying the relative position of the discs with respect to one another as well as for varying the spring tension exerted by spring means associated with the tension discs. The devices of this type which preceded the present invention are relatively complex in nature using several coil type springs and adjustment means therefor which makes them costly and difficult to assemble. Furthermore, prior tension devices of this type provide only a linear relationship between dial setting and resulting thread tension.

It is a purpose of the present invention to provide a thread tensioning apparatus of the type generally referred to which is simpler in construction, easier to assemble, relatively less costly, and in which predetermined nonlinear relationship between dial setting and resulting thread tension is readily attainable.

GENERAL DESCRIPTION OF THE INVENTION

In accordance with the present invention, a thread tension device is provided in which an elongated flat spring member is attached at one end to the axially shiftable member operably connected to the tension discs and is fixed at its opposite end. An adjustable abutment member comprising an eccentric disc is disposed for contacting one side of the flat spring member and a slidable fulcrum member including a fulcrum projection is disposed for contacting engagement with the opposite side of the flat spring member in an area between the abutment member and the end of the spring connected to the axially shiftable member. The slidable member is operably connected to an adjustment dial such that, when the dial is turned, axial shiftable movement of the slidable member substantially parallel to the spring member will be initiated by the dial member thereby varying the fulcrum point of contact between the fulcrum member and the spring. It will be seen that, when the position of the dial is changed and the fulcrum contact point is thus changed, the spring pressure exerted on the axially shiftable member will be changed thus resulting in a change in the force with which the tension discs are biased together. As will be apparent from the following detailed description, the construction of the present invention is substantially more simple than prior devices of this type and results in a simplification in assembly and a savings in cost thereof.

I have found that when a leaf spring is employed which is uniform in width, thickness and without curvature in its free state, a substantially linear relationship between dial setting and resulting thread tension will be provided. Non-linear relationships between the dial settings and resulting thread tension may be attained with the construction of this invention simply by varying the contour of the leaf spring along its length. While variation in the spring width, thickness, free state curvature, or any combination of these can influence nonlinearity in resulting tension to dial setting relationships, spring thickness is extremely critical and therefore relatively costly to effect, free state curvature can interfere with the freedom of movement of the sliding fulcrum along the spring. Consequently, variation of the width of the leaf spring contour has been found to be the most practical and therefore the preferential mode of influencing such non-linearity in accordance with this invention.

DESCRIPTION OF THE DRAWINGS

The preferred embodiment of the invention will be best understood by referring to the following detailed description with the accompanying drawings wherein.

DETAILED DESCRIPTION OF THE PREFERRED EMBODIMENT

Figure 1:
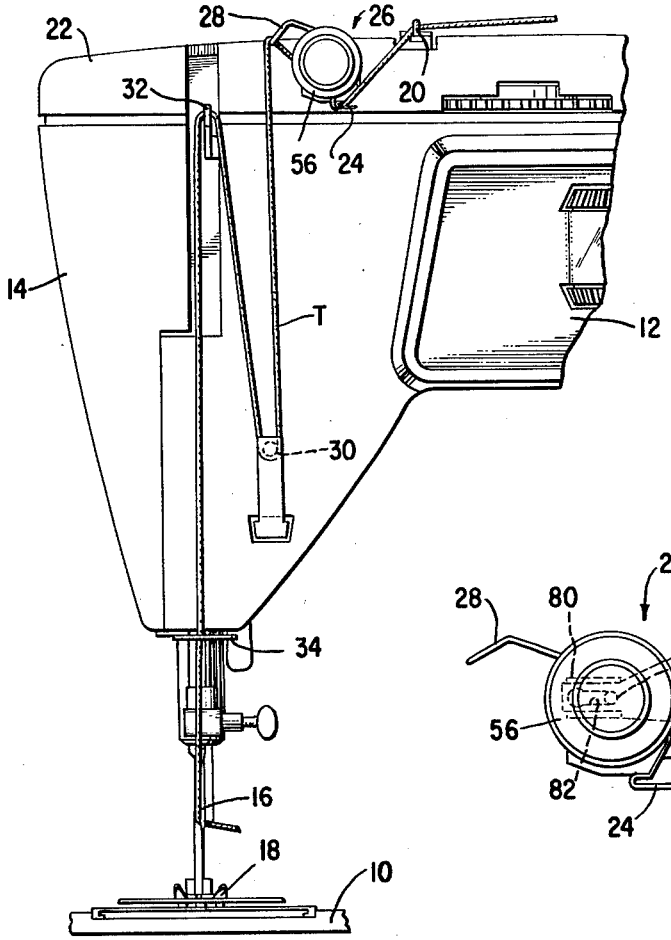
FIG. 1 is a front view of a portion of a sewing machine illustrating the present invention incorporated therein.

Referring to FIG. 1, a portion of a sewing machine is illustrated therein as including a bed 10, an arm 12 which overhangs the bed 10 and terminates in a sewing machine head 14. The arm 12 and head 14 are hollow and, as is well known in the art are provided with mechanism (not shown) for reciprocating the sewing machine needle 16 for penetrating the work with a needle thread "T". A presser foot 18 is also provided for holding the work down during the sewing operation and is connected to a presser bar mechanism for raising and lowering the presser foot as is well known in the art. The thread "T" is normally supplied by a spool (not shown) supported on the sewing machine and may pass through a stationary thread guide 20 on the cover plate 22 of the sewing machine, through a thread finger or guide 24 carried by thread tension device 26, through said tension device 26 and through a check spring guide 28 also carried by the thread tension device 26. The thread after leaving the check spring 28 may be threaded through a stationary thread guide post 30 disposed below the tension device 26 on the sewing machine frame, to a take-up member 32 which is part of the take-up mechanism of the sewing machine, and then through a stationary thread guide 34 on the lower part of the head 14 and finally to the needle 16.

Figure 2:
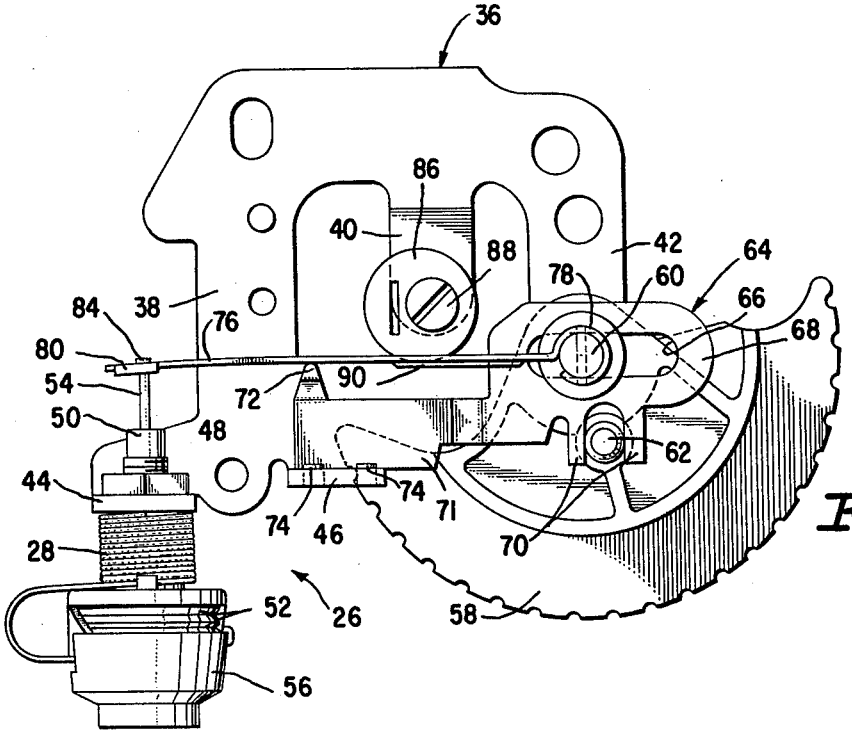
FIG. 2 is a top plan view of the tension mechanism of the sewing machine illustrated in FIG. 1 with the present invention incorporated therein.

With reference to FIG. 2, the tension mechanism itself can be seen to be generally of the type illustrated and described in U.S. Pat. No. 3,677,414 issued June 6, 1972. The tension mechanism 26 of the present invention includes a frame member 36 which is preferably a thin plate-like member which is preferably stamped from a metal sheet. The frame 36 includes substantially parallel legs 38, 40 and 42 and upturned legs 44 and 46 which are substantially perpendicular to the legs 38, 40 and 42. As also seen in FIG. 2, the frame 36 is provided with a plurality of apertures through which screws or the like may be passed for fastening the frame member to suitable bosses or the like in the cover 22 of the sewing machine.

The tension disc portion of the mechanism is supported on upturned leg member 44 of the frame 36 by means of a nut 48 threaded on to the threaded portion of a hollow shaft 50 upon which are supported the tension discs 52. A tension rod 54 passes through the bore in the shaft 50 and is operatively connected to the tension discs 52 to apply a tension force thereon when the rod is shifted axially away from the tension discs. A light coil spring (not shown) may be provided under the cover 56 in biasing relationship with the discs 52 to impart a small force thereto even when the tension device is set at a minimum tension adjustment. The cover 56 also provides a reception seat for a coil at one extremity of the check spring 28 with the remainder of the coils of the check spring 28 being accommodated in surrounding relationship with the hollow shaft 50 and relatively anchored thereto.

An adjustment dial member 58 is provided for easy access to the operator and, as shown in FIG. 1, protrudes through a slot in the machine cover 22. The dial member 58 is pivotally supported on a post 60 carried by the frame member 36 and is also provided with an upstanding pin 62 which, as will be understood hereinafter, serves as a crank driving pin. An axially slidable plate member or linearly movable bracket member 64 is provided with a slot 66 in a leg thereof which slot 66 is disposed in surrounding engagement with the pin 60 on the frame member 36. Depending from the leg portion 68 of the slidable member 64 are spaced legs 70 between which and in sliding engagement therewith is disposed the crank pin 62. As will be apparent, when the dial member 58 is turned to the left, or clockwise, as viewed in FIG. 2, the crank pin 62 will be swung around the axis of the post 60 thereby initiating axial sliding movement of the slidable member 64 to the left. As further shown in FIG. 2, the slidable member 64 has a substantially elongated shape and is also substantially flat. The slidable member 64 is also preferably formed by a stamping operation. The member 64 is provided with a leg portion 71 which has at one end an upstanding projection 72 which may be termed a fulcrum projection means. On the edge of the leg 71 opposite to the fulcrum projection member 72, the leg 71 is supported between guide pins 74 carried by the upturned leg portion 46 of the frame 36 (see FIG. 3).

An elongated flat spring member 76 is formed at one end with a circular configuration 78 wrapped around the post 60 in tight frictional engagement therewith so that it may be said that the end 78 is fixed relative to the post 60. The opposite end 80 of spring 76 is formed with a slot 82 through which projects an enlarged head end 84 of the rod 54. An abutment means for the spring 76 is also provided and includes an eccentric disc 86 supported on the leg 40 of the frame 46 about an axis spaced from the center of said disc 86 by means of a screw 88. The disc 86 is disposed relative to the spring 76 so that the outer circumferential edge thereof may bear against the spring 76 in a depression 90 (see FIG. 3) formed in the flat surfce thereof and on the side opposite from the side in contact with the fulcrum projection 72. The spring 76 may be pretensioned or the minimum value of the tension preset by loosening the screw 88 and adjusting the position of the eccentric disc relative to the spring 76.

As seen further in FIG. 2, the abutment projection 72 is disposed so that it contacts the one side of the spring 76 along a section of the spring between the abutment disc contact point with the spring 76 and the connection point between the end of the spring 80 and the rod 54. When the axially slidable member 60 is caused to slide either to the left or to the right as viewed in FIG. 2 the contact point of the fulcrum projection 72 will be shifted along the spring 76. Therefore, when such an adjustment is made, namely the turning of the adjustment dial 58, to change the fulcrum projection contact point with the spring 76, the spring force exerted by the spring 76 on the rod 54 will be changed resulting in a change in the friction force which the tension discs 52 can apply to a thread T therebetween. For example, should the adjustment dial be turned to its extreme right hand or counter-clockwise position as viewed in FIG. 2, wherein the pin 60 will rest in the extreme left hand portion of the slot 66, the fulcrum projection member will be moved to its furthest position away from the rod 54 and its closest position to the eccentric disc 86 but still intermediate these points. When in this position the force applied by the spring 76 to the tension discs will be very small. As the adjustment dial is adjusted in the opposite or clockwise direction or to the left as viewed in FIG. 2, the lever arm will increase and thus the spring 76 will be influenced to impart an increased force biasing the tension discs together.

Figure 3:
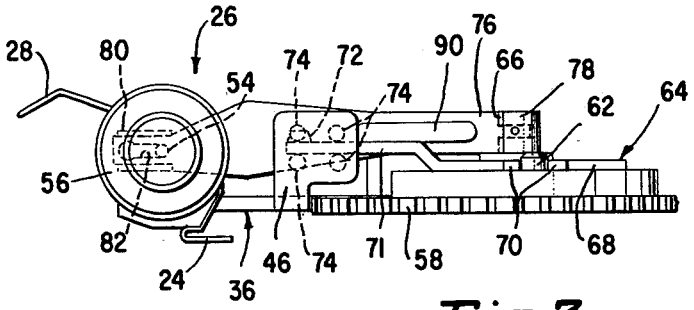
FIG. 3 is a front plan view of the tension mechanism illustrated in FIG. 2.

The varying contour of the spring 76 in width dimension along its length is illustrated in FIG. 3 and includes a section 92 of uniform width extending from the circularly configured end 78, a section 93 of gradually increasing width to a widest point 94, a portion 95 tapering in gradually decreasing width to a free end portion 96 of uniform width.

Figure 4:
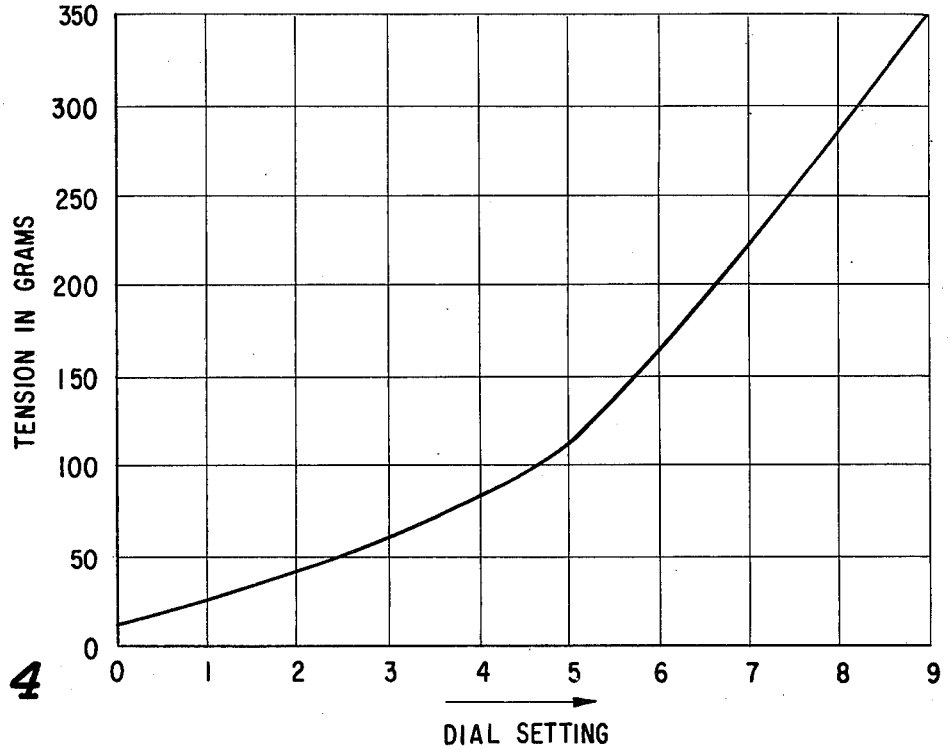
FIG. 4 is a graph illustrating the relationship of dial setting to resulting thread tension provided by a leaf spring with the contour shown in FIGS. 2 and 3.

As shown in FIG. 4, the relationship between the position of the fulcrum projection 72 which is influenced by the setting of the dial 58 and the resulting thread tension is non-linear when the spring contour is shaped as shown in FIG. 3. The arrow drawn along the abscissa in FIG. 4 indicates the clockwise direction of dial movement as shown in FIG. 2 and it will be noted that for the low tension settings which are obtained during the first half of the dial movement, the slope of the curve is substantially lower than for the high tension settings. It is advantageous to be able to attain a greater accuracy in the range of the low tension settings than in the high tension settings because small tension differences are more significant and noticable when decorative stitches are being formed wherein low thread tensions are required.

Figure 5:
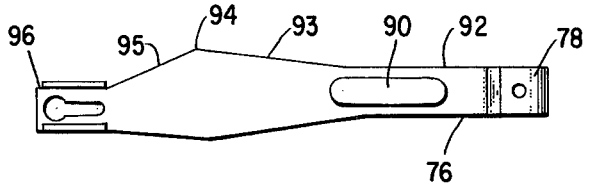
FIG. 5 is an elevational view of the leaf spring shown in FIGS. 2 and 3.

As shown in FIG. 5, the spring 76 may be formed alternatively with a varying thickness contour in which the thickness tapers gradually to the greatest dimension at 104 in order to provide a non-linear relationship of thread tension to dial setting which is generally similar to that shown in graph of FIG. 4.

Figure 6:
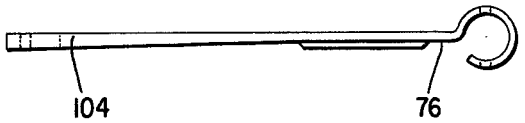
FIG. 6 is an elevational view of a first modified form of leaf spring with the spring thickness exaggerated and in which the contour of the spring in thickness is varied along its length to provide substantially the same tension curve as is shown in FIG. 4.
Figure 7:
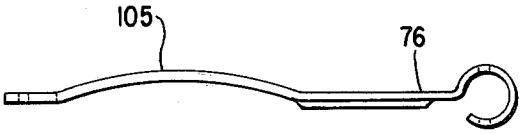
FIG. 7 is an elevational view of a second modified form of leaf spring in which the contour of the spring in its free state curvature along its length is formed to provide substantially the same tension curve as is shown in FIG. 4.

In FIG. 6 a still further modified form of construction for the spring 76 is shown in which the spring in its free or unstressed state is not flat as in the form illustrated in FIGS. 1-3 and 5, but rather has a curved portion 105 in order to provide substantially the same non-linear relationship of the thread tension to dial setting as is shown in graph of FIG. 4.

It will be appreciated that any one or combination of the above described contours may be employed for the spring 76 in oder to attain the thread tension curve with respect to dial setting which is desired.

As seen from the description above and the accompanying drawings, the mechanism of the present invention is relatively simple in construction and is relatively easy to assemble. When comparing the present mechanism to the prior art mechanisms, as for example that shown in U.S. Pat. No. 3,667,414 referred to above, it will be seen that a number of parts which require relatively careful manufacturing procedures have been eliminated and have been replaced by relatively simple mechanisms which may be manufactured by relatively simple processes, as by stamping or the like. Further, the relative number of parts in the mechanism of the present invention has been reduced in comparison with the prior art type mechanisms. As will be apparent, the relative ease of manufacturing and assembly will lead to a cost reduction thereby making the mechanism of the present invention more economical to produce. The mechanism of the present invention is also readily adapted to disc-type tension mechanisms without requiring a major reconstruction of the sewing machine itself and may be readily substituted for the prior art type know mechanisms. While the invention has been described in its preferred embodiment it will be apparent to those skilled in the art that various changes and modifications may be made therein without departing from the spirit and scope of the invention as defined in the appended claims.

Having thus described the nature of the invention what is claimed herein is:

1. In a sewing machine, a tension device including spaced friction discs for applying frictional resistance to movement of a thread therebetween, axial shiftable means operably connected to said discs for initiating movement of said discs relative to one another, an elongated spring connected at one end to said axial shiftable means and connected at the opposite end to fixed structure of the machine, an abutment means disposed for contacting one side of said elongated spring between the opposite ends thereof, and slidable tension adjustment means including a fulcrum projection disposed for bearing against the other side of said elongated spring means between said one end of said elongated spring means and said abutment means such that a force will be applied to said axial shiftable means through said elongated spring means in accordance with the position of said fulcrum projection relative to said one end and said abutment means.

2. In a sewing machine as recited in claim 1 further comprising tension adjustment means connected to said slidable tension adjustment means for initiating sliding movement thereof, said tension adjustment means being disposed for access by a sewing machine operator.

3. In a sewing machine as recited in claim 1 wherein said elongated spring means comprises a flat leaf spring.

4. In a sewing machine as recited in claim 1 wherein said abutment means comprises a disc supported by a stationary frame member on an axis spaced from the center of said disc.

5. In a sewing machine as recited in claim 4 wherein said disc is supported for adjustment about said axis and relative to said elongated spring means whereby an initial tension on said elongated spring means may be preset by adjusting said disc relative to said elongated spring means.

6. In a sewing machine as recited in claim 1 wherein said slidable tension abutment means comprises a substantially flat plate member, said plate member being supported in a fixed frame member having means for guiding said plate member for sliding movement relative thereto.

7. In a sewing machine as recited in claim 2 wherein the contour of said flat leaf spring is varied along at least that section of said spring against which said fulcrum projection bears so as to provide for a non-linear relationship between said fulcrum projection settings and the tension applied to a thread by said tension device.

8. In a sewing machine as recited in claim 2 wherein the flat leaf spring is varied in width along at least that section of said spring against which said fulcrum projection bears so as to provide for a non-linear relationship between said fulcrum projection settings and the tension applied to a thread by said tension device.

9. In a sewing machine as recited in claim 8 wherein the width dimension of said flat leaf spring along that section of said spring against which said fulcrum projection bears is smallest at each extremity of said section and tapers gradually to a largest width dimension intermediate the extremities of said section.

* * * * *